US007981283B2

(12) United States Patent
Happel

(10) Patent No.: US 7,981,283 B2
(45) Date of Patent: Jul. 19, 2011

(54) ADJUSTABLE FILTER BASKET FOR A STORM WATER DRAIN SYSTEM

(76) Inventor: Henry Happel, Rockledge, FL (US); Dolores J. Happel, legal representative, Rockledge, FL (US)

( * ) Notice: Subject to any disclaimer, the term of this patent is extended or adjusted under 35 U.S.C. 154(b) by 267 days.

(21) Appl. No.: 12/292,431

(22) Filed: Nov. 18, 2008

(65) Prior Publication Data

US 2009/0134081 A1 May 28, 2009

Related U.S. Application Data

(60) Provisional application No. 61/003,566, filed on Nov. 19, 2007.

(51) Int. Cl.
*B01D 35/02* (2006.01)
*E03F 5/14* (2006.01)

(52) U.S. Cl. ..... 210/162; 210/236; 210/238; 210/249; 210/359

(58) Field of Classification Search ..... None
See application file for complete search history.

(56) References Cited

U.S. PATENT DOCUMENTS

| | | | | |
|---|---|---|---|---|
| 4,895,653 | A * | 1/1990 | Cherochak | 210/400 |
| 6,428,692 | B2 | 8/2002 | Happel | |
| 6,872,029 | B2 * | 3/2005 | Allard et al. | 405/36 |
| 7,270,747 | B2 | 9/2007 | Happel et al. | |
| 2006/0201860 | A1 * | 9/2006 | Happel et al. | 210/162 |
| 2009/0134081 | A1 * | 5/2009 | Happel et al. | 210/162 |

* cited by examiner

*Primary Examiner* — Robert James Popovics
(74) *Attorney, Agent, or Firm* — William M. Hobby, III

(57) ABSTRACT

A nutrient separating filter basket apparatus for a storm water drain system has an adjustable filter basket installed in a storm water drain pipe system to receive storm water runoff therethrough. The filter basket collects organic materials, such as grass clippings, leaves and tree stems therein and is adjustable for different ground water levels.

9 Claims, 3 Drawing Sheets

ADJUSTABLE FILTER BASKET FOR A STORM WATER DRAIN SYSTEM

This application claims the benefit of U.S. Provisional Application No. 61/003,566, filed Nov. 19, 2007.

The present invention is a nutrient separating filter basket for a storm water drain system. An adjustable filter basket is installed in a storm water drainpipe system and receives storm water runoff therethrough and collects organic materials, such as grass clippings, leaves and tree stems therein and is adjustable for different ground water levels.

BACKGROUND OF THE INVENTION

Drain water, which is frequently laden with trash, grass clippings, tree leaves and stems, sand, gravel, and other forms of sediment, is collected from streets, parking lots and other areas into a storm drain inlet where it is directed into a storm water drain pipe system. The drain water laden with trash, leaves, grass clippings, sand and gravel collected from the streets is fed through an entrance into a storm water catch basin and into a lake or retention pond. The retention pond can tolerate a certain amount of grass clippings and leaves collected from parking lots or along the street but debris left in the water for a long period of time decays and allows a buildup of soluble nutrients, such as nitrates and phosphates, to accumulate in the water. Thus, it is desirable to remove organic debris from the water collected from the drain water before it enters into lakes and retention ponds.

The present filter basket is added directly to the storm water drain pipe system for collecting trash, leaves, grass clippings, tree stems, and other organic matter in a manner to dry these materials before they can rot in the water and release soluble nutrients into the water. Sand, gravel, or other non-organic sediments can pass through the basket screen walls and are collected within a drain water catch basin. The present system provides for an easily cleaned filter basket which allows rapid cleaning of the filter basket and filter box in situ.

In rivers and other bodies of water, such as lakes and ponds, the groundwater levels vary on a seasonal basis so that the nutrient separating baffle box has to have a screened basket which should ideally be kept at 3-4" above the water level for optimum performance. Nutrient separating filter baskets, however, are normally fixed in position within a storm water drain system. The baffle box can be adjusted as to height with great difficulty.

The present invention provides for an easy and rapid adjustable filter basket which can be rapidly adjusted for ground water level and the water entering the storm water drain baffle box.

In my prior U.S. Pat. No. 6,428,692 for an In-Line Storm Water Drain Filter System an in-line storm water drain filter and baffle box is installed within a storm water drain pipe to direct storm water runoff through the storm water drain pipe and through the filter and baffle box prior to the storm water drain water passing through an outfall into a lake, pond or retention area. This patent is for a filter system and includes a housing having an inlet and outlet and a plurality of chambers formed therein. The housing cover allows for access into a housing. A plurality of filter screens are mounted over each of the plurality of housing chambers for collecting trash from the storm water passing therethrough.

In my prior U.S. Pat. No. 7,270,747, I provide a storm water drain system having a nutrient separating filter basket installed within the storm water pipe system to receive storm water runoff therethrough and to collect organic materials, such as grass clippings, leaves, and tree stems. The filter basket in the storm water drain has a rigid frame and a plurality of screen sides in the top and bottom and open front end attached to the interior wall edges. An inlet feed chute attached to the filter basket open front end is positioned in front of the storm water housing inlet for directing storm water and debris into the filter basket. The water entering the housing inlet is directed by the inlet feed chute into the basket and through the screen sides and bottom while the filter basket is collecting the organic debris therein.

The present invention is an improvement to this prior U.S. patent and allows a screened filter basket to be readily adjustable to receive the inflow of storm water for different water levels entering a baffle and separating box for collecting the larger debris within the screen basket.

SUMMARY OF THE INVENTION

An adjustable filter basket for a storm water filter vault or box has a plurality of basket supporting posts mounted to the floor of a filter vault. The filter basket has a rigid frame having filter screens attached thereto and has an inlet chute for receiving storm water entering the vault. The filter basket rigid frame is slidably attached to a plurality of basket supporting posts. The basket frame has a plurality of threaded brackets thereon while each basket supporting post has a protruding flange extending from the top thereof and having an opening therethrough. A threaded rod is rotatably attached in the protruding flange and threadably attached to the filter basket rigid frame threaded bracket so that rotating the threaded rod in the protruded flange will threadably raise or lower the filter basket on the basket supporting post to adjust the position of the inlet chute for different ground water levels. Each threaded rod has a crank handle on one end thereof having a crank attached to one end of the threaded rod and a handle at the end of the crank for rotating the crank to raise or lower the filter basket. Each basket post can have a protruding flange thereon with a threaded rod rotatably attached thereto engaging a separate threaded bracket attached to the filter basket rigid frame. The threaded basket can be removably attached, such as by bolting to the rigid frame. The rigid frame may be made of a plurality of angle iron frame members and each of the plurality of posts can have a square cross section.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
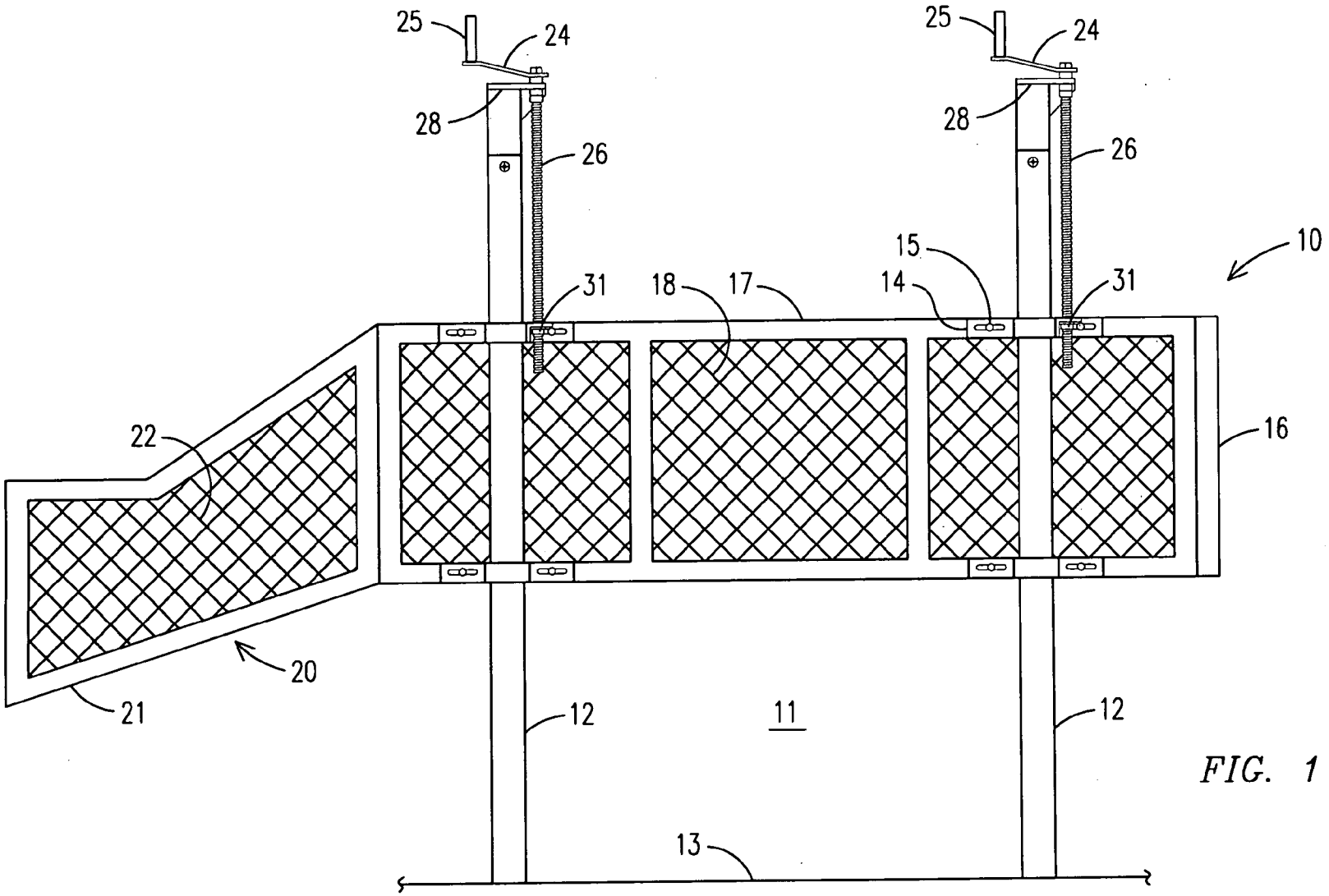
FIG. 1 is a sectional view of an adjustable filter box mounted in a baffle and settling box.
Figure 2:
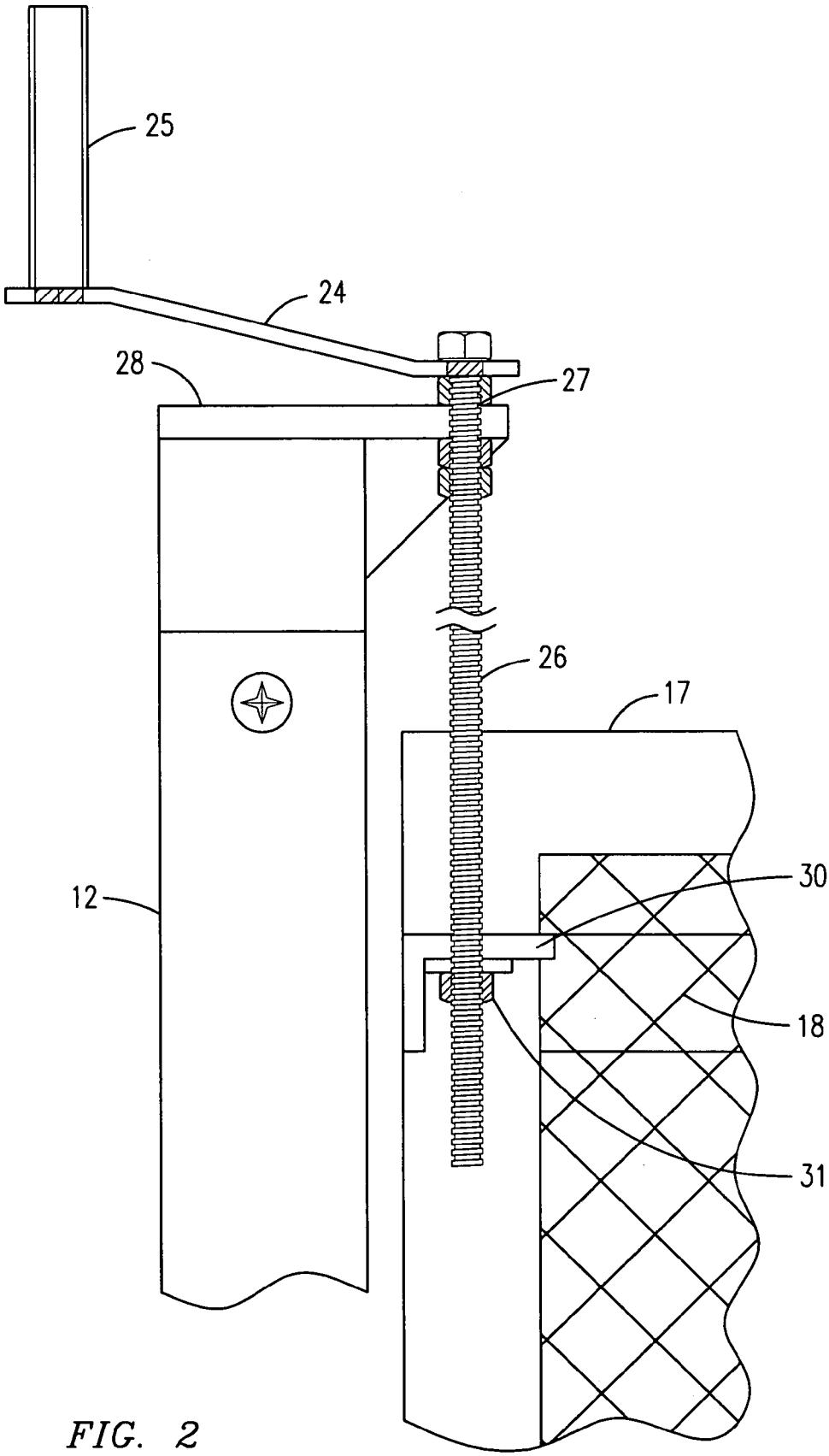
FIG. 2 is a partial sectional view of an adjustable filter basket of FIG. 1.
Figure 3:
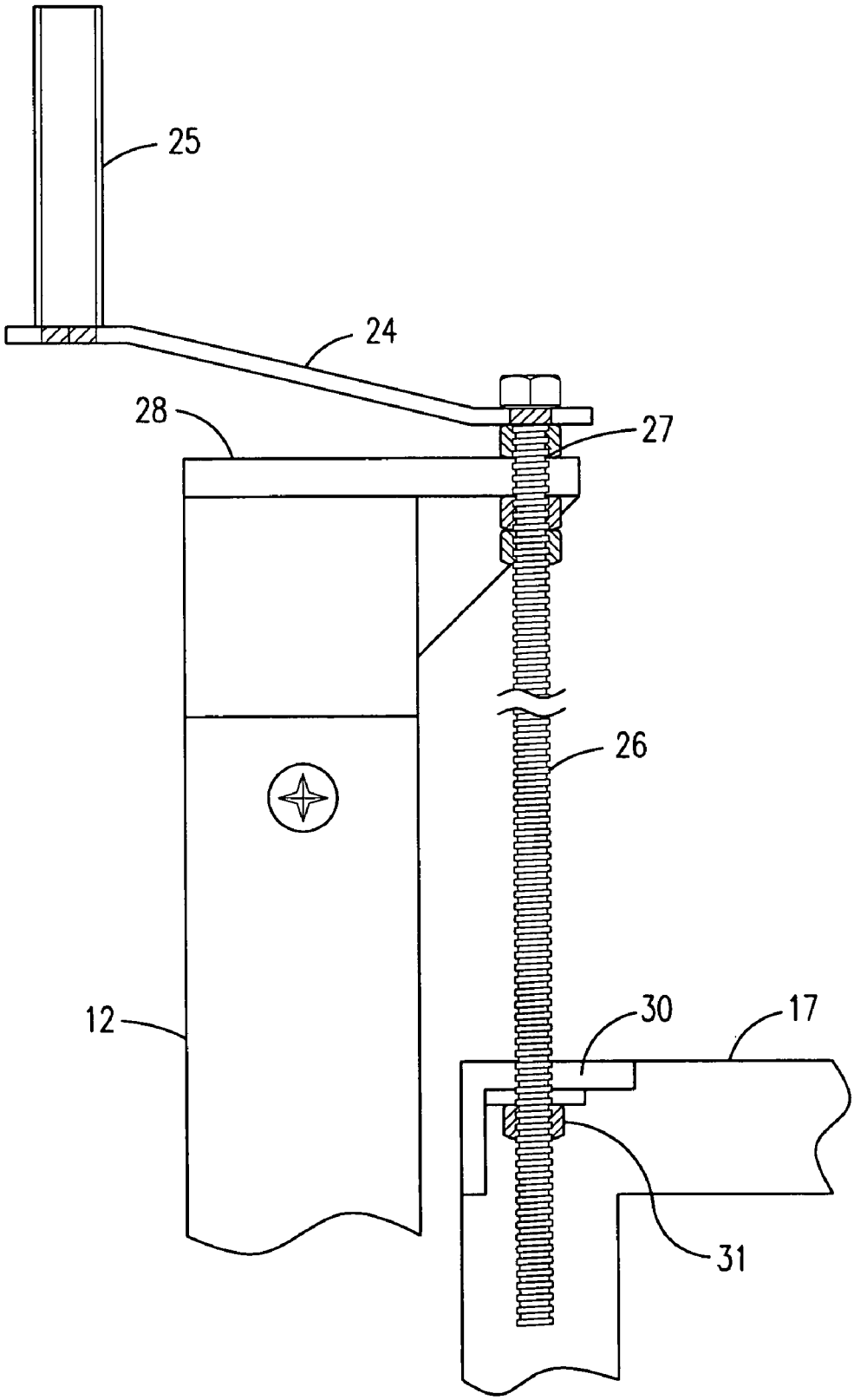
FIG. 3 is a partial sectional view of the raising and lowering mechanism of the filter basket of FIG. 1.

Referring to the drawings of FIGS. 1 through 3, an adjustable filter basket 10 is shown mounted in the baffle and settling box or vault 11 and supported on four posts 12 which are mounted on the floor 13 of the baffle vault 11. Filter basket 16 is slidably supported on the posts 12 by a pair of brackets 14 for each of the posts 12. Each bracket 14 wraps around a post 12 and is threadedly attached with the fasteners 15 to the basket's 16 angle iron frame 17. The basket 16 frame 17 has a filter screen 18 attached between sections of the frame 17. An inlet feed chute 20 has frame members 21 with filter screens 22 mounted between the frame members 21. The ramp 20 has an opening which faces the inlet to the settling vault 11 for receiving trash, grass clippings, stray leaves, and the like thereinto which is ramped on the angled bottom surface of the ramp and to the main filter basket 16.

The hand crank 24 has a handle 25 thereon and is attached to a threaded rod 26 which is supported in the opening 27 in a top support plate 28. The threaded rod 26 is rotated in an opening through a bottom support plate 30 which has an internally threaded nut 31 fixedly attached to the plate 30. The plate 30 is attached to the filter basket 16 frame 17 so that rotating the crank handle 24 will rotate the threaded rod 26 in the rod supporting plates 27 and 30 and will thread the rod 26 through the nut 31 to thereby raise the filter basket 16. A threaded rod and crank handle is attached to each post 12 and each is interconnected to the basket 16 in the same manner so that each of the crank handles 24 can be rotated in small increments or can be rotated simultaneously to raise the filter basket 16. The filter basket can be lowered by reversing the rotation of the crank handles 24.

This system rapidly allows the adjustment of the filter basket with the ramped inlet 20 to adjust for the water level entering the inlet and the water level in the baffle and settling box 11. The filter basket 16 needs to be kept just above the water level in the settling box in order to catch the trash, grass clippings, tree leaves, stems and the like from entering into the settling box or being maintained in the water extending over the bottom of the filter basket 16 to prevent the decay of the organic matter and the buildup of nutrients, such as phosphate, within the storm drain water.

It should be clear at this time that an adjustable filter basket has been provided for a storm water drain system. However, it should also be clear that the present invention is not to be considered as limited to the forms shown which are to be considered illustrated rather than restrictive.

I claim:

1. An adjustable filter basket for a storm water filter vault comprising:

a filter vault having a floor;

a plurality of basket supporting posts mounted in said filter vault;

a filter basket having a rigid frame and having an inlet chute for receiving storm water entering said vault, said filter basket rigid frame being slidable attaching to a plurality of basket supporting posts and said filter basket rigid frame having at least one threaded bracket thereon;

at least one said basket supporting post having a protruding flange having an opening therethrough; and a threaded rod rotatably mounted in said protruding flange and threadedly mounted to said filter basket rigid frame threaded bracket, said threaded rod having a crank handle on one end thereof adjacent said basket supporting post protruding flange for rotating said threaded rod to raise or lower said filter basket;

whereby rotating said threaded rod in said protruding flange will threadedly raise and lower said filter basket on said basket supporting posts.

2. The adjustable filter basket in accordance with claim 1 having four filter basket posts each said post having a protruding flange hereon.

3. The adjustable filter basket in accordance with claim 2 having four threaded rods, one threaded rod rotatable mounted in each said protruding flange on each said post.

4. The adjustable filter basket in accordance with claim 3 in which each said threaded bracket is removably attached to said rigid frame.

5. The adjustable filter basket in accordance with claim 4 in which each said threaded bracket is bolted to said rigid frame.

6. The adjustable filter basket in accordance with claim 5 in which said frame includes a plurality of metal frame members.

7. The adjustable filter basket in accordance with claim 6 in which each of said plurality of posts has a square cross-section.

8. The adjustable filter basket in accordance with claim 7 in which each said handle is crank handle having a crank attached to one threaded rod and having a generally vertically extending handle rotatably attached to said crank for rotating said crank and threaded rod.

9. The adjustable filter basket in accordance with claim 8 in which said frame has two threaded brackets attached thereto for each said post whereby said filter basket is slidably supported on said four posts with eight slidable brackets.

* * * * *